US005840634A

United States Patent [19]

Chamberlin et al.

[11] Patent Number: 5,840,634

[45] Date of Patent: Nov. 24, 1998

[54] SEALING OF BONDED BATTS

[75] Inventors: Susan Carol Chamberlin, Wilmington; Wo Kong Kwok, Hockessin; Robert Wallace Slavin, Newark, all of Del.

[73] Assignee: E. I. du Pont de Nemours and Company, Wilmington, Del.

[21] Appl. No.: 589,661

[22] Filed: Jan. 22, 1996

[51] Int. Cl.[6] ..... B32B 31/00

[52] U.S. Cl. ..... 442/361; 442/362; 442/363; 442/364; 442/374; 442/381; 152/62.6; 152/62.8; 152/308.2; 19/163; 19/302

[58] Field of Search ..... 428/288, 296, 428/287, 373; 156/62.6, 62.8, 308.2, 622; 19/145, 296, 302, 163; 442/361, 362, 363, 364

[56] References Cited

U.S. PATENT DOCUMENTS

| | | | |
|---|---|---|---|
| 2,341,130 | 2/1944 | Unsworth | 157/62.8 |
| 2,483,404 | 10/1949 | Francis, Jr. . | |
| 4,129,675 | 12/1978 | Scott . | |
| 4,794,038 | 12/1988 | Marcus . | |
| 4,869,771 | 9/1989 | Le Van . | |
| 4,950,541 | 8/1990 | Tabor et al. . | |
| 5,154,969 | 10/1992 | Kerawalla . | |
| 5,169,580 | 12/1992 | Marcus . | |
| 5,227,109 | 7/1993 | Allen, III et al. . | |
| 5,437,909 | 8/1995 | Herzberg . | |
| 5,554,442 | 9/1996 | Matsunaga et al. . | |

FOREIGN PATENT DOCUMENTS

| | | |
|---|---|---|
| 0070164 | 1/1983 | European Pat. Off. . |
| 9416135 | 7/1994 | WIPO . |

*Primary Examiner*—Michael W. Ball
*Assistant Examiner*—Sam Chuan Yao

[57] ABSTRACT

An improvement in the sealing of bonded batts of fiberfill is obtained by providing a barrier layer of bonded bicomponent binder fibers on one or both faces of the remainder of the batt to prevent or reduce the tendency of the fiberfill to leak through such faces.

1 Claim, 1 Drawing Sheet

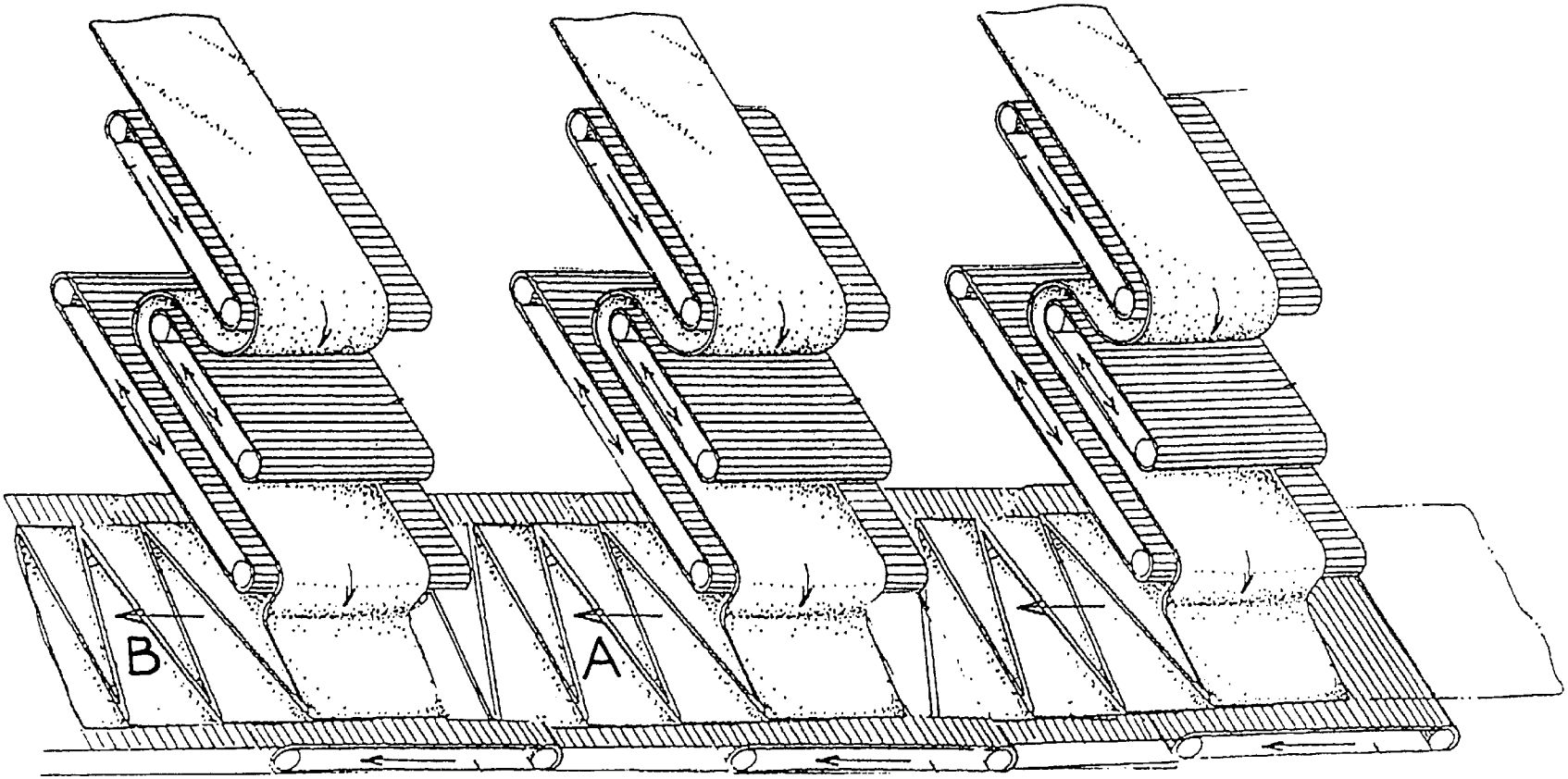
FIGURE

SEALING OF BONDED BATTS

FIELD OF THE INVENTION

This invention relates to improving the sealing of bonded batts of fiberfill, such as are used as filling and/or insulating material, and more particularly to such new and improved bonded batts and to processes for obtaining them.

BACKGROUND OF THE INVENTION

Polyester fiberfill filling material (sometimes referred to herein as polyester fiberfill) has become well accepted as a reasonably inexpensive filling and/or insulating material in apparel, such as parkas and other insulated articles of apparel and sleeping bags, and for other filled articles, such as cushions and other furnishing materials, including bedding materials, such as mattress pads, quilts, comforters and including duvets, because of its bulk filling power, aesthetic qualities and various advantages over other filling materials, so is now manufactured and used in large quantities commercially.

Filling materials are often of staple fiber, sometimes referred to as cut fiber in the case of synthetic fiber, which is crimped, and is provided in the form of continuous bonded batts (sometimes referred to as battings) for ease of fabrication and conversion of staple into the final filled articles. Traditionally, bonded batts have been made from webs of parallelized (staple) fiber that preferably comprise a blend of binder fibers as well as of regular filling fibers, which can consequently be referred to as load-bearing fibers, such as poly(ethylene terephthalate) homopolymer, often referred to as 2G-T. These webs are made on a garnett or other type of card (carding machine) which straightens and parallelizes the loosened staple fiber to form the desired web of parallelized, crimped fibers. The webs of parallelized fibers are then built up into a batt on a cross-lapper. The use of binder fiber intimately blended with the load-bearing fiber throughout the batt has generally been preferred because heating to activate the binder material (of the binder fiber) can provide a "through-bonded" batt. Bicomponent binder fiber with components that soften at different temperatures, preferably a higher melting component, such as 2G-T, and a binder component that softens and bonds at a sufficiently lower temperature (than such higher melting component) is preferred, especially sheath/core bicomponent binder fibers, i.e., where the binder material is a sheath around a core of the higher melting component, so the latter can act as load-bearing fibers after bonding. The batt has usually been sprayed with resin and heated to cure the resin and any binder fiber to provide the desired bonded batt. The resin has been used to seal the surface(s) of the batt (to prevent leakage) and also to provide bonding.

Improvements in sealing bonded batts have been suggested in several prior disclosures, such as LeVan U.S. Pat. No. 4,869,771. More recently, Frankosky et al. in U.S. Pat. No. 5,225,242, in application Ser. No. 08/396,291, filed Feb. 28, 1995, now allowed and to issue as U.S. Pat. No. 5,527,600, and in WO 95/01475, disclosed using a resin-bonding agent having a glass transition temperature ($T_g$) of about 0° C. or less to improve sealing (often referred to as reducing percolation or "leakage" of fibers), especially with fiberfill of lower dpf (denier per filament). This has proved very effective so long as the resin remains on the surface of the batting (to prevent fibers from penetrating through the surface and eventually through any shell fabric). We have, however, found that resin-sealing has not been so effective in preventing leakage of higher denier fibers, such as 10 or more dpf (0.9 denier being the same as 1 dtex); we have found that less of the (sprayed) resin tends to remain on the batt surface when such higher denier fiberfill is sprayed with resin. If the amount of resin were increased, then this would increase the stiffness of the bonded batt which would also be undesirable.

So an important problem that remains to be solved is how to improve the sealing of bonded batts of higher dpf fiberfill.

SUMMARY OF THE INVENTION

According to the invention, we provide a bonded batt having opposed faces and comprising polyester fiberfill of dtex 0.2–50 and a barrier layer that (1) comprises about 5 to about 25% by weight of the batt, (2) is located at one or both of said faces and (3) consists essentially of bonded bicomponent fiber of dtex 1–10 having components that soften at different temperatures (as indicated hereinbefore), i.e., one component of which softens at a higher temperature than does the other component which is a binder material that softens at a temperature that is at least 100° C. and that is also lower than the temperature at which said fiberfill begins to soften.

We have found that providing such a barrier layer (of bonded binder fiber) solves the problem mentioned above and that such barrier layers can be used with advantages with batts of fiberfill of lower dpf also. As will be seen hereinafter, a bonded binder fiber layer has provided leakage control that has compared very favorably vs. a resin-bonding agent with fiberfill of regular dpf. Eliminating (or reducing) the need to spray resin-bonding agent also avoids (or reduces) associated problems and/or costs, such as waste-treatment and emission controls.

There is also provided, according to another aspect of the invention, a process for preparing a bonded batt, comprising carding polyester fiberfill feed fibers of dtex 0.2–50 to provide a web of fibers, cross-lapping one or more of such webs to form a first batt, carding to form one or more bicomponent binder fiber webs from bicomponent binder fibers of dtex 1–10, one component of which softens at a higher temperature in contradistinction from the other component which is a binder material that softens at a temperature that is at least 100° C. and that is lower than said higher temperature and lower than the temperature at which said fiberfill begins to soften, forming a combined batt with opposed faces by combining said first batt with a layer comprising one or more of such bicomponent binder fiber webs at one or both faces of said first batt, and heating the combined batt to a temperature that is higher than the softening temperature of the binder material and lower than said higher temperature or the temperature at which said fiberfill begins to soften so the binder material softens and bonds to form a barrier layer of bonded binder fiber, and cooling the heated batt. If desired, said bicomponent binder fiber webs may themselves be cross-lapped to form a binder fiber layer batt that is combined at one or both faces of said first batt.

As indicated, any barrier layer of bonded bicomponent fiber according to the invention generally comprises about 5 to about 25% of the weight of the batt. Thus, barrier layers on both opposed faces may amount to as much as about 50% of the weight of the batt. Preferably, a barrier layer will comprise at least about 9%, and preferably up to about 20%, by weight of the batt, the precise amount depending on the performance to be expected, and aspects such as the dpf and stiffness of the various fibers.

Preferably the bonded batts are through-bonded with bonded bicomponent fiber of dtex 1–10, one component of which softens at a higher temperature than does the other component which is a binder material that softens at a temperature that is at least 100° C. and that is lower than (said higher temperature and also lower than) the temperature at which the fiberfill begins to soften, in amount up to about 25%, preferably about 5 to about 25%, by weight calculated on the sum of its own weight and that of the polyester fiberfill. Such preferred through-bonded batts may be prepared by using a blend of the polyester fiberfill of dtex 0.2–50 and of such bicomponent binder fiber in appropriate amount as feed fibers. The bicomponent fiber used for through-bonding may be the same as used for the barrier layer, or may be different, as can be seen in the Examples hereinafter.

Further aspects of the invention will be apparent hereinafter.

BRIEF DESCRIPTION OF DRAWING

The FIGURE is a schematic illustration of a cross-lapper operation to provide a multi-layered batt including a barrier layer according to the invention.

DETAILED DESCRIPTION OF THE INVENTION

Most elements of the bonded batts of the invention and of processes for their preparation are conventional and disclosed in the art, such as Frankosky et al. and LeVan, referred to above, Hoffman U.S. Pat. No. 3,271,189, Ryan U.S. Pat. No. 3,488,217, Mead et al. U.S. Pat. No. 3,454,422, Tolliver U.S. Pat. No. 3,772,137, Stanistreet U.S. Pat. No. 4,068,036, Scott U.S. Pat. No. 4,129,675, Salamon et al. U.S. Pat. No. 4,146,674, Pamm U.S. Pat. No. 4,281,042, Frankosky U.S. Pat. No. 4,304,817, Siniscalchi U.S. Pat. No. 4,551,383, Hernandez et al. U.S. Pat. No. 5,458,971 and application Ser. No. 08/542,974, filed Oct. 13, 1995 (DP-6320-C), Frankosky et al. U.S. Pat. No. 5,480,710, Kwok application Ser. No. 08/582,267, filed Jan. 3, 1996 now U.S. Pat. No. 5,618,364 (DP-6485-A), and Takemoto Japanese Published Application No. 58-214,585 (1983), so further repetition would be redundant.

The essence of the present invention, as indicated, is the use of a barrier layer of bonded bicomponent binder fiber to reduce or prevent leakage (percolation) of fiberfill fibers from the remainder of the batt, i.e., to seal the face(s) of the bonded batt. Generally, it will be convenient and most effective for the barrier layer to consist only of such bonded binder fiber, i.e., essentially 100% of such bonded fiber, but small amounts of other fibers may prove acceptable provided effective sealing is achieved. As bicomponent binder fibers, there may be used those commercially available and/or referred to in the art, including the art referred to herein. Desirably, the bonding (softening) temperature of the binder material component will be at least about 25° C. lower than the temperature(s) at which the fiberfill and higher temperature component soften. Binder materials having sharply defined melting points (crystalline) have been mentioned, for example, by Frankosky et al. in U.S. Pat. No. 5,480,710, but binder materials that are not crystalline have generally been used in commercially available binder fibers, and are used in the Examples hereinafter. Generally, it will be desirable to seal both faces of the batt. Sometimes, as indicated in the art, only one face of a batt need be sealed; if desired, such batts may be used folded over with a barrier layer on both outermost faces or two batts may be used with unsealed faces adjacent each other, as indicated in the art. Generally, the batts will have a basis weight of at least 50 $g/m^2$, and generally up to about 500 $g/m^2$. The precise amounts of bicomponent binder fiber will generally depend on the desired end-use and features such as the deniers of the fibers. It will generally be undesirable to use more binder fiber in the barrier layer(s) than required to provide effective sealing, as too thick a bonded binder fiber barrier layer could affect aesthetics, such as bending stiffness and drape. The dpf of the binder fiber will have an effect on performance, as will the dpf of the fiberfill. Most commercial bicomponent binder fibers comprise 50% by weight of binder material (of lower softening temperature) and 50% of higher softening point (load-bearing) polymer, but other proportions may be used. Most commercial binder fibers are sheath/core, but other configurations may be used such as side-by-side, provided the binder material is exposed at a surface, so it can perform its bonding function effectively.

The invention is further illustrated in the following Examples, all parts and percentages being by weight, unless otherwise indicated; proportions of fibers are calculated with regard to the fiber content only, whereas the amount of any resin-bonding agent is calculated with regard to the weight of the bonded batt, including the resin as well as the fibers; the term "basis weight" was used in relation to various batts as weight/unit area measured on a face of the batt. Measurements were made as described in the art referred to; "Wash Durability Rating (WD)" was as described in U.S. Pat. No. 5,225,242 (ASTM D-4770-88), a rating of at least 3 after 3 washes being preferred; the effectiveness of the scaling on a face was measured by counting the number of fibers leaking from the face of a panel measuring 22×11 inches (56×28 cm) covered with a nylon shell fabric as described in LeVan U.S. Pat. No. 4,869,771, values generally being given for the initial batt (unwashed) and also after 1 wash and after 3 washes. As will be seen, for convenience of comparison in the Examples, each bonded batt according to the invention was made with a barrier layer consisting essentially of bonded binder fiber applied to only 1 face thereof, whereas the opposing face was sealed by being sprayed with 9% (by weight) of a soft resin-bonding agent, specifically KANEBO X-4280J latex, and the numbers of fibers leaked from each of the opposed faces of such a panel were measured and are given in the Table following the Examples; as indicated, use of such a resin-bonding agent was already known; this was a convenient way to measure the sealing effect according to the invention. The numbers of fibers leaked from the faces sealed with a barrier layer consisting essentially of bonded binder fiber are given first in each instance and the numbers of fibers leaked from the other faces are given next (in parentheses), showing that the sealing according to the invention was at least as effective as the resin-bonding used for comparison. When high dpf fiberfill was used (Example 4), the bonded binder fiber barrier layer was much more effective than spraying with 9% of KANEBO X-4280J. Even when the fiberfill was of lower dpf than in Example 4, the bonded binder fiber barrier layer leaked significantly less fiberfill after 1 wash, as shown in Examples 2 and 3. It should also be explained that the numbers (in parentheses) of fibers leaked from faces sprayed with resin after 3 washes were sometimes lower than the numbers leaked from the same faces after only 1 wash because the fibers on those surfaces of the batts had matted down and the fibers had entangled together which was not at all desirable (but did reduce the numbers of fibers shown as having leaked in those instances).

EXAMPLE 1

A 100 pound (45 Kg) sample of mixed staple fiberfill containing 55% silicon-slickened polyester fiber of 5.5 dpf (6.1 dtex), 27% silicon-slickened polyester fiber of 1.65 dpf (1.8 dtex), and 18% MELTY® 4080 binder fiber of 4 dpf (4.4 dtex), all of 2.5 inch (63 mm) cut length, was opened in a hopper/opener, and the mixed fibers were fed to two separate garnetts, so each garnett produced a continuous web about 60 inches (150 cm) wide and having a basis weight of about 1 oz./yd.$^2$ (34 g/m$^2$). Each web was passed through a separate produce cross-lapper to produce cross-lapped batts on a conveyor moving at a speed of about 8 yds./min. (7.3 m/min.). The conveyor collected and combined both cross-lapped batts to form a multiple-layered batt (as shown at A in the FIGURE) having a basis weight of about 3 oz./yd.$^2$ (100 g/m$^2$). In a separate opener, 20 pounds (9 Kg) of 2 dpf (2.2 dtex) MELTY® 4080, 2 inch (5 cm) cut length was opened in a hopper/opener and fed to a third garnett which produced another continuous web about 60 inches (150 cm) wide and having a basis weight of about 0.3 oz./yd$^2$ (10 g/m$^2$). This web of 2 dpf MELTY® binder fiber was passed through another cross-lapper to produce a cross-lapped batt of about 0.7 oz./yd.$^2$ (23 g/m$^2$) on top of the multi-layered batt of mixed fiber on the moving conveyor as shown at B in the FIGURE to give a final combined batt of basis weight about 4 oz./yd.$^2$ (133 g/m$^2$) whose top layer consisted of 100% 2 dpf MELTY® 4080. This batt was passed into a first path of a conventional 3-path oven. This first path was at 150° C. to activate binder material on the surface of both the 2 dpf MELTY® 4080 in the top layer of the batt and the 4 dpf MELTY® 4080 throughout the rest of the batting during a residence time of about 1 minute in the oven. After leaving the oven, the batt was inverted and passed into a spray zone where the KANEBO X-4280J latex was sprayed on what was now the top face of the batt, and the batt was carried by a second conveyor to the second path of the oven (at 170° C.) to cure the resin and further heat the binder fiber. The batting was fed to the third path of the oven (at 170° C.) to heat the batt for an additional minute. The sum of these heating times was 3 minutes.

The final batting had a basis weight of 4.4 oz./yd.$^2$ (145 g/m$^2$), a thickness of 0.66 inch (165 mm), a bending stiffness of 69 CN/cm$^2$ (machine direction 31 and cross direction 38), and a wash durability rating of 4.5 after 3 washes. The 2 dpf MELTY® barrier layer was at least as effective as the resin-sprayed face in preventing fiber migration, as shown in the Table following the Examples.

EXAMPLE 2

This batt was made essentially as described in Example 1, except that the basis weight of the multi-layered batt of A was about 4 oz/yd.$^2$ (133 g/m$^2$), and that the barrier layer (of basis weight as in Example 1) was made with 4 dpf (4.4 dtex) (instead of 2 dpf) MELTY® 4080 (same cut length), and the final batting had a basis weight of 5 oz./yd.$^2$ (165 g/m$^2$), a thickness of 0.63 inch (158 mm) and exhibited a wash durability rating of 5 after 3 washes.

Significantly less fiber migrated through the face with the binder fiber barrier layer than through the other face after 1 wash, as shown in the Table. As explained previously, after 3 washes the resin-sprayed face had undesirably matted fibers.

EXAMPLE 3

This batt was made essentially as for Example 2, except that the multi-layered batt at A was made from 100% silicon-slickened fiber of 5.5 dpf (6.1 dtex), 2.5 inch (63 mm) cut length, without any MELTY® and with a basis weight of about 4.1 oz/yd.$^2$ (135 g/m$^2$), to give a final batting having a basis weight of about 5.1 oz./yd.$^2$ (170 g/m$^2$), a thickness of 0.78 inch (about 2 cm), bending stiffness of 93 CN/cm$^2$ (machine direction 39 and cross direction 54), and a wash durability of only 2–3 after 3 washings as the MELTY® 4080 barrier layer had poor adhesion to the remainder of the batt and was separated after washing.

As in Example 2, after 1 wash, less fiber migration was observed through the 4 dpf MELTY® 4080 barrier (even though it was not adhered to the batt) vs. the opposing face, as shown in the Table.

This Example demonstrates the disadvantage when binder fiber is not distributed throughout the batt to provide adequate adhesion and to resist any tendency for the binder fiber barrier layer to be peeled off by washing. Even without good adhesion to the remainder of the batt, however, the binder fiber layer acted as an excellent barrier to prevent fiber migration.

EXAMPLE 4

This batt was made essentially as described in Example 1, except that the polyester staple blend multi-layered batt contained 82% silicon-slickened fiber of 15 denier (16.7 dtex) and 3 inch (76 mm) cut length (and 18% of the same 4 dpf MELTY® 4080 binder fiber) and had a basis weight of about 4 oz./yd.$^2$ (133 g/m$^2$), and the barrier layer (of 2 dpf MELTY® 4080) had a basis weight of about 0.6 oz./yd.$^2$ (20 g/m$^2$), so the final batting had a basis weight of 4.9 oz./yd$^2$ (162 g/m$^2$) and a thickness of 0.94 inch (34 mm). Much less fiber migration was observed through the 2 dpf MELTY® 4080 barrier vs. the resin face of this batt as shown in the following Table.

TABLE

| | Barrier Layer | Number of Fibers Leaked After Indicated Washes | | |
|---|---|---|---|---|
| Ex. No. | Binder Fiber | 0 | 1 | 3 |
| 1 | 2 dpf | 0(0) | 0(1) | 4(5) |
| 2 | 4 dpf | 0(0) | 0(4) | 0(1*) |
| 3 | 4 dpf | 0(2) | 0(7) | 0(1*) |
| 4 | 2 dpf | 0(3) | 1(16) | 1(21) |

The first figure indicates the number leaked from the face with the binder fiber barrier layer. The second figure, in parentheses, was the number of fibers leaked from the other face. The asterisks * indicate that, after 3 washes, the resin-sprayed faces in Examples 2 and 3 had matted fibers that had entangled together, as mentioned previously.

COMPARISON

Another batt was processed essentially as described in Example 4, except there was no barrier layer and the basis weight of the batt was about 6 oz./yd$^2$ (200 g/m$^2$). No resin was sprayed onto the batting. The final batting (after heating in the oven) had a basis weight of 5.9 oz./yd.$^2$ (195 g/m$^2$) and thickness of 0.93 inch (24 mm). As shown in the following Table, this comparison batting had serious fiber migration problems from both faces.

| | Number of Fibers Leaked From Panel | | |
|---|---|---|---|
| Faces | Initial | After 1 Wash | After 3 Washes |
| 1 | 2 | 15 | 16 |
| 2 | 6 | 25 | 26 |

As can be seen from this Comparison and from Example 4, a serious leakage problem existed with bonded batts of higher dpf fiberfill and use of that resin-spray did not provide wash-durable sealing, in contrast with the success obtained by using a barrier layer of bonded bicomponent binder fibers according to the invention. Thus, the invention provides an effective solution to the existing problem of sealing bonded batts of higher dpf, higher than about 6 dpf, and especially 10 dpf, or higher; as indicated, 0.9 denier is the same as 1 dtex. As can be seen in the other Examples, however, use of a barrier layer of bonded bicomponent binder fiber according to the invention was at least as effective also in sealing bonded batts of polyester fiberfill of lower dpf as was the resin-spray, and there may well be advantages in avoiding using resin-spraying as discussed earlier, so the invention may have utility and advantages also in sealing such bonded batts of polyester fiberfill of lower dpf.

The foregoing Examples have illustrated processes according to the invention wherein the barrier layers of bonded bicomponent fiber have been formed from cross-lapped batts of bicomponent binder fiber. Another possible process according to the invention is to form binder fiber layers from one or more carded webs of bicomponent binder fiber, instead of or in addition to using such cross-lapped batts. Thus a binder fiber layer may be built up by layering one or more webs of carded bicomponent binder fiber on the top and/or the bottom of a cross-lapped batt of fiberfill to form a combined batt which is then heated to soften the binder material, and cooled. Equipment is available in the art to produce such bonded batts.

We claim:

1. A bonded batt having opposed faces and consisting essentially of polyester fiberfill that is of dtex 0.2–50 and that is through-bonded with bonded bicomponent fiber of dtex 1–10, one component of which softens at a higher temperature than does the other component which is a binder material that softens at a temperature that is at least 100° C. and that is also lower than the temperature at which the fiberfill begins to soften, said bonded bicomponent fiber being in amount about 5 to about 25% by weight calculated on the sum of its own weight and that of the polyester fiberfill, and of a barrier layer that (1) comprises about 5 to about 25% by weight of the batt, (2) is located at one or both of said faces and (3) consists essentially of bonded bicomponent fibers of dtex 1–10, one component of which softens at a higher temperature than does the other component which is a binder material that softens at a temperature that is at least 100° C. and that is also lower than the temperature at which said fiberfill begins to soften.

* * * * *